US006089155A

United States Patent [19]

Kemmerer et al.

[11] Patent Number: 6,089,155

[45] Date of Patent: Jul. 18, 2000

[54] SYSTEM FOR TURNING A SHEET IN A PRINTING MACHINE

[75] Inventors: Klemens Kemmerer, Seligenstadt; Harald Bayer, Rodgau, both of Germany

[73] Assignee: MAN Roland Druckmaschinen AG, Germany

[21] Appl. No.: 09/276,052

[22] Filed: Mar. 25, 1999

[30] Foreign Application Priority Data

Mar. 31, 1998 [DE] Germany ..... 198 14 320

[51] Int. Cl.[7] ..... B41S 5/02

[52] U.S. Cl. ..... 101/183; 101/230

[58] Field of Search ..... 101/142, 183, 101/230, 231, 232

[56] References Cited

U.S. PATENT DOCUMENTS

| | | | |
|---|---|---|---|
| 4,014,261 | 3/1977 | Becker | 101/183 |
| 4,869,166 | 9/1989 | Mathers | 101/230 |
| 5,579,691 | 12/1996 | Voge | 101/183 |
| 5,598,779 | 2/1997 | Haas et al. | 101/230 |
| 5,609,103 | 3/1997 | Stephan | 101/230 |
| 5,762,333 | 6/1998 | Sugiyama et al. | 101/230 |

FOREIGN PATENT DOCUMENTS

| | | |
|---|---|---|
| 1 262 294 | 3/1968 | Germany . |
| 27 56 507 | 6/1978 | Germany . |
| 26 33 183 C2 | 12/1989 | Germany . |
| 36 02 084 C2 | 12/1989 | Germany . |

*Primary Examiner*—Eugene Eickholt
*Attorney, Agent, or Firm*—Leydig, Voit & Mayer, Ltd.

[57] ABSTRACT

The invention relates to a method and apparatus turning a sheet in a printing machine. More specifically, a swing arm is provided to grip a trailing edge of a sheet delivered on a first cylinder and transfer the gripped edge to a second cylinder. The invention provides low-outlay sheet-turning apparatus which provides smear-free sheet transportation. In conjunction with the swing arm, the second cylinder has secant-like flattened sections, or a non-circular cross-section, forming clearance areas within an outer circumference of the second cylinder as defined by a rotary path of radially outward portions of the second cylinder. In face-and-reverse printing mode, these clearances enable the swing arm to synchronously travel a sheet-feed path which intersects the circumference of the second cylinder. With this motion the swing arm draws the sheet from the first cylinder in a substantially tangential manner, avoiding dramatic curving of the sheet. The swing arm deposits the transferred edge of the sheet to a gripper on the second cylinder, which carries the sheet to a downstream cylinder. When the sheet is transferred onto the downstream cylinder, it is "turned over" relative to its initial orientation. In a face printing mode, the swing arm can be fixed in a position near the second cylinder, the swing arm having openings which deliver a flow of air against the sheet to assist in guiding the sheet onto the second cylinder.

20 Claims, 6 Drawing Sheets

SYSTEM FOR TURNING A SHEET IN A PRINTING MACHINE

FIELD OF THE INVENTION

The invention generally relates to printing machines and more particularly relates to a system for transferring and turning a sheet between series-arranged printing units in a printing machine.

BACKGROUND OF THE INVENTION

Sheet turning devices in printing machines are generally known. For example, German patent publication DE 27 56 507 A1 discloses a series-configuration rotary printing machine for face printing and face-and-reverse printing. In this machine, a sheet located on an intermediate drum is gripped at its trailing edge by a pivoting gripper. The gripped edge of the sheet is transported to a second intermediate drum, whereon the gripped edge is the leading edge relative to the direction of cylinder rotation. The pivoting gripper uses mechanical gripping elements to removing and transporting the sheet. Each of these intermediate drums is a sheet-guiding cylinder with a solid lateral surface that is essentially cylindrical, i.e., each cylinder is essentially circular in cross-section. To avoid a collision between the pivoting gripper and one of the drums as the pivoting gripper moves, the intermediate drum has one or more movable segments, with the gripping elements, that move the drum surface radially inwardly at certain times during the swinging movement. The shaft of the pivoting gripper can be moved eccentrically and is synchronized with the rotational movement of the intermediate drum. With the pivoting gripper withdrawn, the printing machine can be operated in face-printing mode.

The device of DE 27 56 507 A1 is disadvantageous in that it requires a high number of parts. For example, a multiplicity of drums must arranged between printing units, and intermediate drum must have the movable lateral-surface segments. Accordingly, this printing machine requires a high outlay for assembly, operation and maintenance. Furthermore, it is necessary to guide the sheet between the drums and the pivoting gripper due to a pronounced curvature of the path along which the sheet is moved. More particularly, smearing would likely result if the pivoting gripper contacted a trailing region of the sheet during a return motion of the pivoting gripper.

A turning apparatus also generally known from German patent publication DE 26 33 183 C2 for a sheet-fed rotary printing machine. This printing machine includes a transfer drum which interacts with a turning drum and a removal device arranged therebetween. The removal device has a gripper arrangement by means of which the sheet, which has been turned on the turning drum, is guided back, with its original trailing edge as the leading edge, to the same transfer drum from which the sheet was sent to the turning drum. The device of DE 26 33 183 C2 is disadvantageous because a turning drum with the associated removal device is required, in addition to the necessary sheet-guiding cylinders, such as impression cylinder and transfer drum.

German patent publication DE 36 02 084 C2 discloses a sheet-transfer drum which is located between printing units of rotary printing machines. The sheet-transfer drum has directing surfaces (flattened sections) between at least two gripper bars. These directing surfaces are designed generally as secants relative to the outer circumference of the drum rotation path. The directing surfaces serve as guide vanes which, during a printing operation, produce a build-up of air that keeps the respective sheet with the printed surface at a distance from the directing surfaces, in an attempt to avoid smearing and double printing.

German patent publication DE-B 12 62 294 discloses a sheet-turning apparatus with a transfer cylinder arranged between the impression cylinders of two printing units of a multicolor rotary sheet-printing machine. During the turning operation, suction grippers, as the first gripper system of the transfer cylinder, attach the sheet by suction at the trailing edge. The first gripper system pivots, on the transfer cylinder, into a clearance and transfers the sheet to a second gripper system, which is likewise arranged on the transfer cylinder. The second gripper system grips and guides the turned sheet, transferring the sheet to a downstream impression cylinder. Disadvantageously, this system requires a considerable number of parts for the transfer cylinder and as a complex and expensive control means for the gripper systems.

OBJECTS AND SUMMARY OF THE INVENTION

It is, therefore, an object of the present invention to provide an improved method and apparatus for turning a sheet in a printing machine which avoids the disadvantages of the prior art. Related objects are to provide a method and apparatus for turning a sheet in a printing machine which is inexpensive, which can be easily retrofit and to facilitate transport of sheets without smearing.

The invention is suitable for transferring a sheet between two printing units arranged in series in a printing machine. In particular, the invention is useful in a printing machine which has one or three transfer drums (sheet-guiding cylinders) between the printing units. For example, a first sheet-guiding cylinder is provided which rotates to deliver a sheet from a first printing unit. The sheet is secured to the first sheet-guiding cylinder with corresponding first grippers. A second sheet-guiding cylinder is located adjacently upstream of the first sheet-guiding cylinder to receive the sheet. Upstream of the second sheet-guiding cylinder is a subsequent transfer cylinder, such as the first sheet-guiding cylinder, of the subsequent printing unit.

According to the invention, a swing arm is operable to grip a sheet from the first sheet-guiding cylinder, and then pivotably transfer the sheet to the second-sheet guiding cylinder, the swing arm being movable through path which intersects circumference of the outer rotary path of the second sheet-guiding cylinder. According to the invention, the second sheet-guiding cylinder has radially-outwardmost portions, at which grippers are generally located. These radially-outwardmost portions travel along, and define, the circumferential path. However, the second sheet-guiding cylinder non-circular in cross section, such as oval, forming clearances. Further according to the invention, the swing arm is movable pivotably and radially with respect to the second sheet-guiding cylinder. The swing arm is movable synchronously with the rotation of the second sheet-guiding cylinder so that the swing-arm passes through the inter-circumferential clearances.

An advantageous feature of the invention is that at least one transfer cylinder is shaped with a non-circular cross-section, forming clearances to avoid collision with the moving swing arm. These clearances are formed by "flattened" surfaces of the cylinder, the surfaces being defined secants relative to an outer circumference of the rotary path of the cylinder. The clearances or cutout sections are within an outer circumference defined by a travel path of radially outwardmost portions of the cylinder.

By permitting the swing arm to move through the inter-circumferential clearance of the sheet-guiding cylinder, the sheets can be transported in a non-smearing manner, since the sheet is curved to a noticeably lesser degree and can be drawn generally tangentially away from the upstream sheet-guiding cylinder, preferably the impression cylinder. An efficient sheet transfer can thus be achieved since the sheet can be transferred from the upstream sheet-guiding cylinder to the downstream sheet-guiding cylinder without subjecting the sheet to any great amount of curvature. In preferred embodiment, the swing arm is configured to direct blowing air toward portions of the sheet, assisting in sheet guidance.

Also, the invention advantageously permits use of few transfer cylinders between the printing units, reducing a necessary number of transfer stations from printing unit to printing unit. The invention may be used in rotary printing machines which each have just one transfer cylinder between two printing units, which herein can also include a coating unit or a processing station.

Finally, a further advantage is provided in that a non-circular transfer cylinder (e.g., delimited by secants) can be used as to guide sheets during either face printing (single-sided printing) or for face-and-reverse printing (double-sided printing). Thus, no separate turning cylinders are necessary and, in the case of existing rotary printing machines with corresponding transfer cylinders for face printing, a small amount of outlay allows the swing arm of the invention to be retrofitted. As a result, a rotary printing machine can be easily modified to extend its use for face-and-reverse printing.

Lastly, irrespective of the operating mode desired, it is possible to design as standard in each case the sheet-guiding cylinders (as impression cylinder in the printing unit and as transfer cylinder in the transfer region) between the printing units, with the result that it is no longer necessary to use one or more turning drums. This also precludes the need for a separation of the drive gear train (during format adjustment or a change in operating mode). The swing arm can be driven separately or can be connected into the drive gear train by means of a coupling.

Other objects and advantages of the invention will become apparent upon reading the following detailed description and upon reference to the drawings.

BRIEF DESCRIPTION OF THE DRAWINGS

The invention will be explained in more detail by way of an exemplary embodiment in the accompanying Figures.

Figure 1:
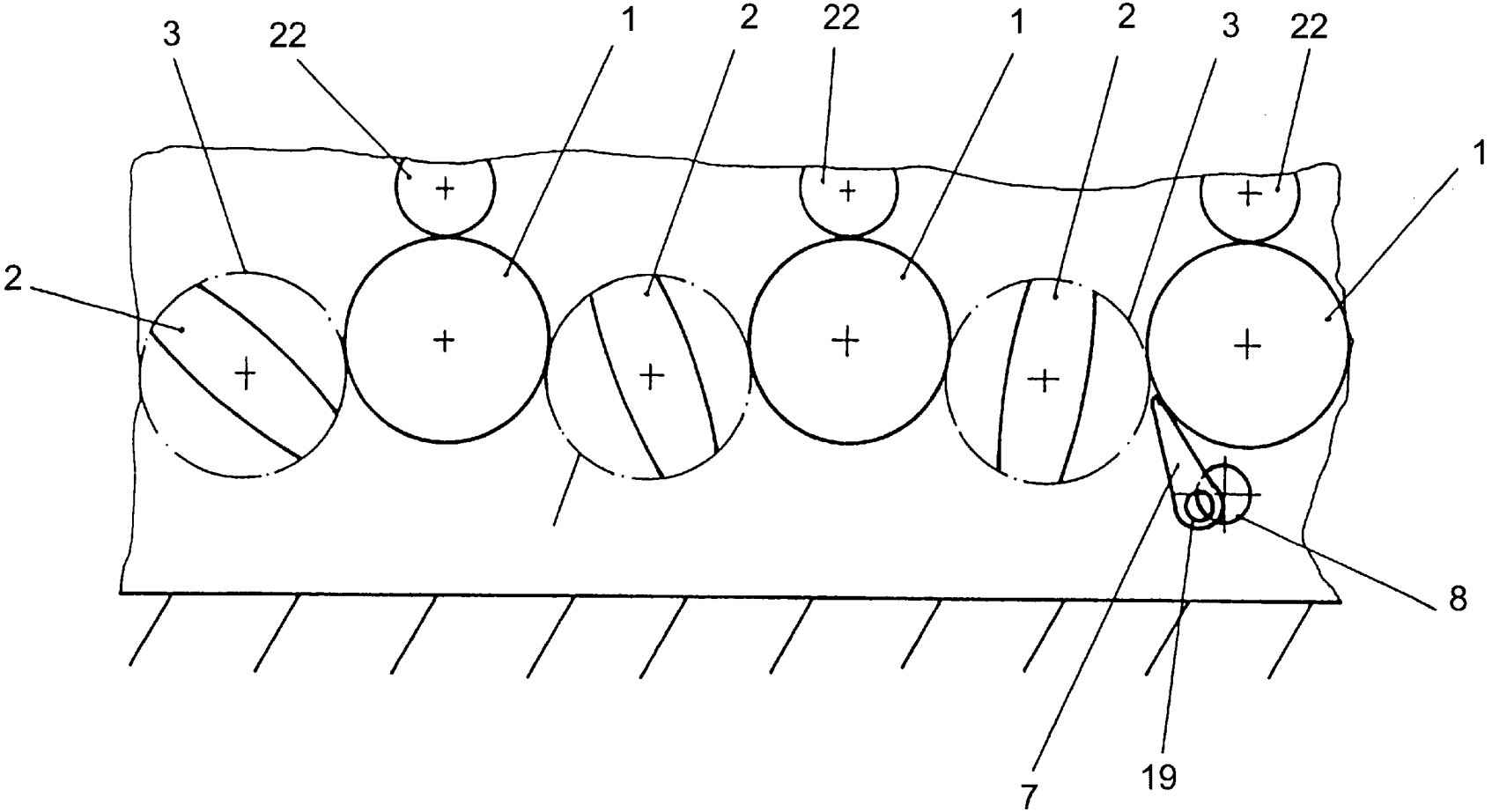
FIG. 1 is a schematic side view of a sheet-fed rotary printing machine having a turning apparatus with a swing arm according to an embodiment of the invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalence falling within the spirit and scope of the invention.

DETAILED DESCRIPTION OF THE DRAWINGS

Referring now more particularly to the drawings, in FIG. 1 there is shown an embodiment of a series-configuration sheet-fed rotary printing machine having multiple printing units. Each printing unit includes a first sheet-guiding cylinder 1, and in this case is an impression cylinder, and a blanket cylinder 22. In a manner known to those skilled in the art, the printing units may include other standard components, such as a plate cylinder, inking unit and, in some cases, a damping unit. In some cases, instead of the blanket cylinder 22, a form cylinder may be provided, for example, as a carrier of a flexible letterpress printing form in a coating unit. The first sheet-guiding cylinder 1 has a plurality of gripper elements 13 mounted symmetrically around its circumference. Between each of the respective printing units, a transfer cylinder or sheet-guiding cylinder 2 is rotatably mounted for transporting the sheets.

According to the invention, a swing arm is movable to grip a sheet from the first cylinder, move along a feed path which intersects a clearance volume of the second cylinder, and pass the sheet to be gripped by the second cylinder. Facilitating this, the second sheet-guiding cylinder has a non-circular cross-section, defining clearance volumes inside of a circular outer rotation path of the second cylinder. In conjunction therewith, the swing arm pivots synchronously with the rotating second cylinder, and moves on a radially-variable path relative to the second sheet-guiding cylinder. Thereby, the swing arm passes through the clearance during the sheet transfer process, such as during a sheet-feeding stroke.

The swing arm has a suction gripper that grips a trailing edge of a sheet on the first cylinder. The swing arm carries this edge along the feed path to be secured to a gripper on the second cylinder. The gripped edge of the sheet is then leading the sheet, being pulled from the first cylinder. The swing arm carries the gripped edge to the second cylinder, which grips the sheet and carries it off. The sheet is subsequently passed from the second cylinder to an adjacently-rotating downstream cylinder of another printing unit, similar to the described first cylinder, the sheet then being in a "turned over" orientation relative to its initial orientation. According to an aspect of the invention, the swing arm is carried on mount that moves both pivotally, as well as radially relative to the second sheet-guiding cylinder, such as in an eccentric manner. As a result, so the swing arm is movable along a return path that is outside of the clearance.

Figure 2:
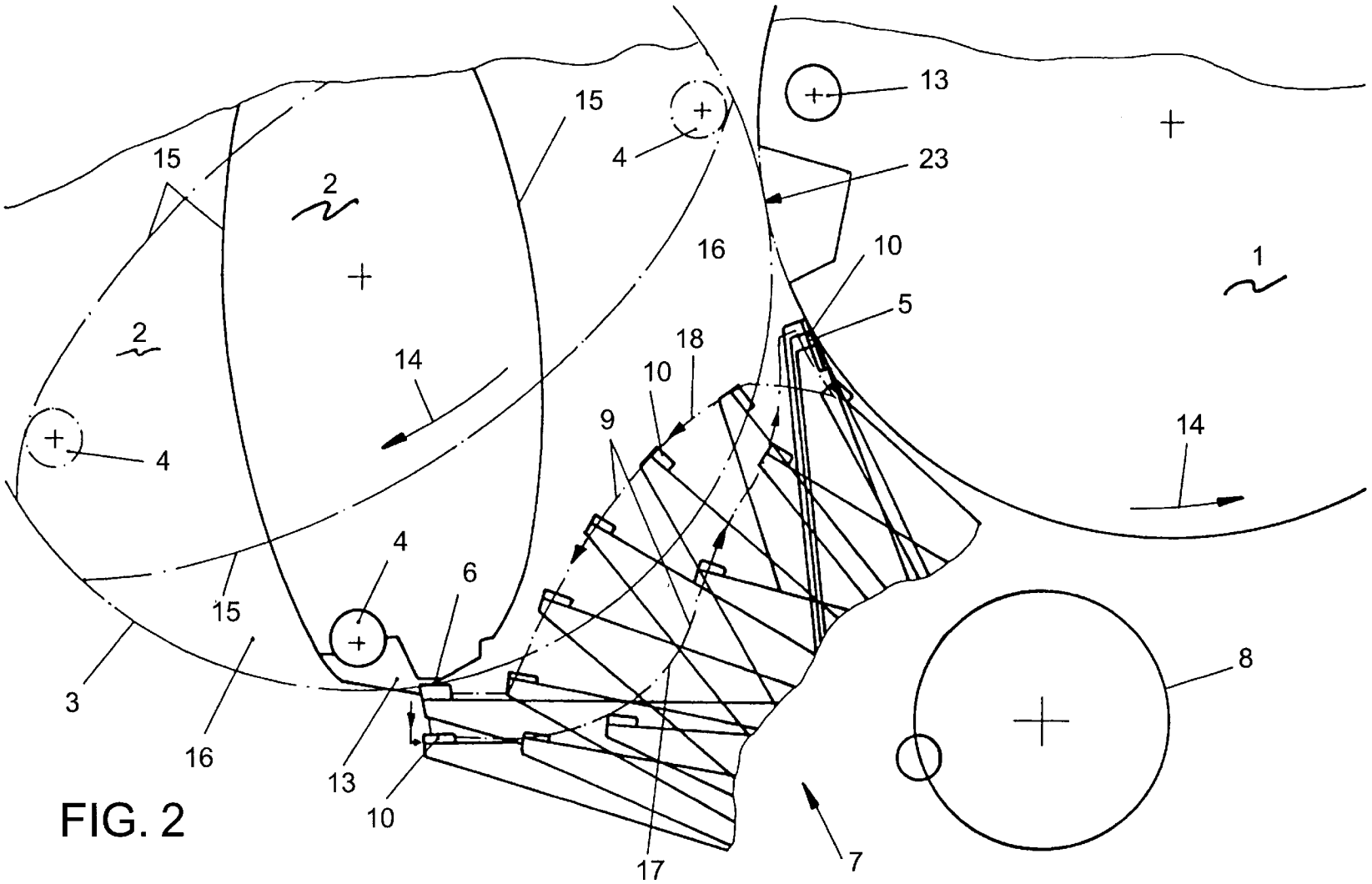
FIG. 2 is a schematic, fragmentary side view of the printing machine of FIG. 1, illustrating the swing arm transfer system along its path of travel relative to the first and second sheet-guiding cylinders.

More particularly, referring to FIG. 2, the swing arm 7 moves on the feed path 18 which intersects the circular path 3 of the second sheet-guiding cylinder 2 so as to pass through the clearance 16, and on a return path 17, which is outside the circular path 3. Advantageously, this feed path 18 allows the sheet 20 to be drawn off from the upstream sheet-guiding cylinder 1 in an essentially tangentially straightened-out form. This avoids buckling of the sheet 20. Another advantage is that the swing arm 11 can be moved back to the receiving region 5, on the return path 17, beneath the trailing region of the sheet 20, thereby avoiding smearing.

FIG. 2 illustrates the first and second sheet-guiding cylinders 1 and 2, respectively, with a swing arm 7. In the illustrated embodiment, the second sheet-guiding cylinder 2 includes a pair of grippers 4 arranged symmetrically generally at the circumference of the rotational path of the sheet-guiding cylinder 2.

To provide operating clearances 16, the second sheet-guiding cylinder 2 is not exactly cylindrical in shape. Rather, the second sheet-guiding cylinder has a cross-section that is not circular, but has generally flattened surfaces 15 that extend along a secant relative to an circular path 3 through which travels an outer radius the second sheet-guiding cylinder 2. As illustrated, the second sheet-guiding cylinder 2 has a generally oblate cross-section, and the flattened surfaces 15 are curved along respective secants relative to the outer circular path 3. The flattened sections 15 may be flat, or slightly curved in either a concave or convex manner. As illustrated, the clearances 16 occupy a space having a generally crescent-shaped cross-section. The grippers 4 are located near radially-outwardmost ends of the second cylinder 2, as seen on the oval cross-section.

For synchronization, the first and second sheet-guiding cylinders 1, 2 have respective diameters approximately double a diameter of the blanket cylinder 22 (referring to a diameter of the outer circular path 3 in the case of the second sheet-guiding cylinder 2). Accordingly, in the present example, the first and second sheet-guiding cylinder 1, 2 each has two grippers 13, 4 respectively mounted thereon, spaced in a circumferentially symmetrical manner. In the region between the two sheet-guiding cylinders 1, 2, a swing arm 7 is arranged beneath these sheet-guiding cylinders 1, 2.

Turning back to FIG. 1, for transferring a sheet from the first sheet-guiding cylinder 1 to the second sheet-guiding cylinder 2, the swing arm 7 has a swing body 11 movably mounted on a joint 19. Moreover, the swing arm 7 is operably linked to a drive 8. The swing arm 7 is described in greater detail in connection with FIGS. 2 and 3.

Figure 4:
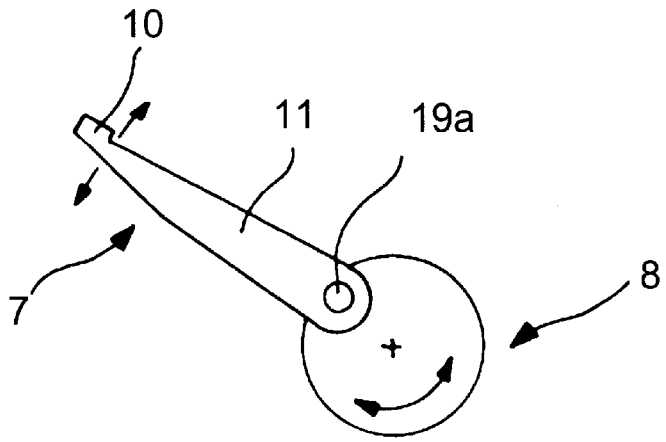
FIG. 4 is a schematic, fragmentary view of a joint with an eccentric linkage.
Figure 5:
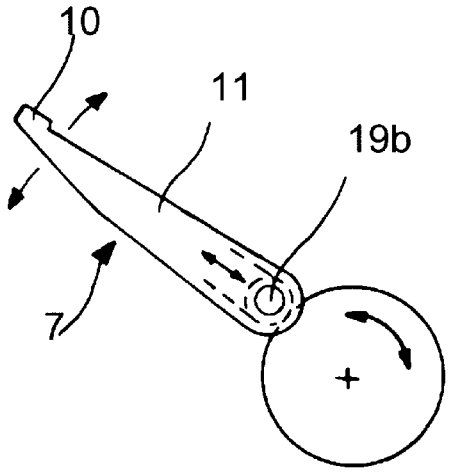
FIG. 5 is a schematic, fragmentary view of a joint with a cam mechanism.
Figure 6:
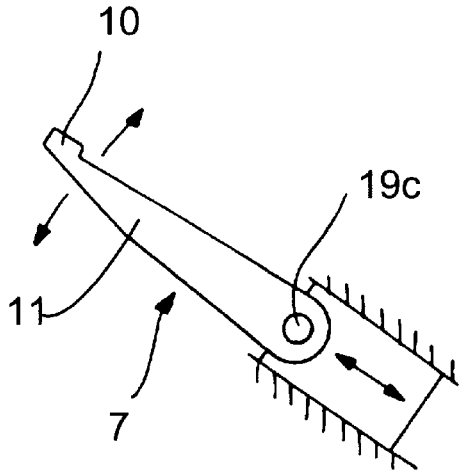
FIG. 6 is a schematic, fragmentary view of a joint with a sliding cam plate.

In order to impart a desired motion of the swing arm 7, the joint 19 may include various structures operable to move the swing arm 7 radially relative to the second sheet-guiding cylinder. For example, as shown in FIGS. 4 and 5 respectively, the joint 19 may include an eccentric linkage 19*a* or a cam mechanism 19*b*, being operably driven by the drive 8 to vary the position of the swing arm 7. Additionally, as shown in FIG. 6, the joint 19*c* may be a cam plate 119 which is electronically controlled and actuated in a manner known in the art, such as, in the manner of a programmable servomotor drive. In this case, the joint 19 is preferably arranged within the swing arm 7 or in an axis-parallel manner with respect to the drive 8. The drive 8 can be independent or it can be coupled to a main drive gear train that drives the printing machine. Depending on the properties of sheets 20 (FIG. 3) to be processed, the format adjustment of the swing arm 7 can be carried out in a stepless manner via the joint 19, by mechanical or electrical means.

To achieve a desired paper-transfer motion, the joint 19 is configured so that the swing arm body 11 moves into and out of the clearance 16 of the second sheet-guiding cylinder 2 in synchronization with the rotation of the first and second sheet-guiding cylinders. More particularly, with reference to FIG. 2, an end of the swing arm body 11 moves along a guide path 9. The path 9 includes a feed path 18, along which the swing arm body 11 moves, through the clearance 16, while transferring a sheet from the first sheet-guiding cylinder 1 to the second sheet-guiding cylinder 2. Completing the cyclic motion, the path 9 also includes a return path 17. The swing arm 7 follows the return path 17 after releasing a leading edge of a transferred sheet 20 (FIG. 3) which has been secured to a gripper 4 on the second sheet-guiding cylinder. As the swing arm 7 moves along the return path 17, the swing arm 7 retracts relative to the second sheet-guiding cylinder 2, outside of the circular path 3 of the second sheet-guiding cylinder. The swing arm 7 thereby avoids a collision with the rotating second sheet-guiding cylinder as the arm body 11 returns to accept another sheet from the first sheet-guiding cylinder 1.

Figure 3:
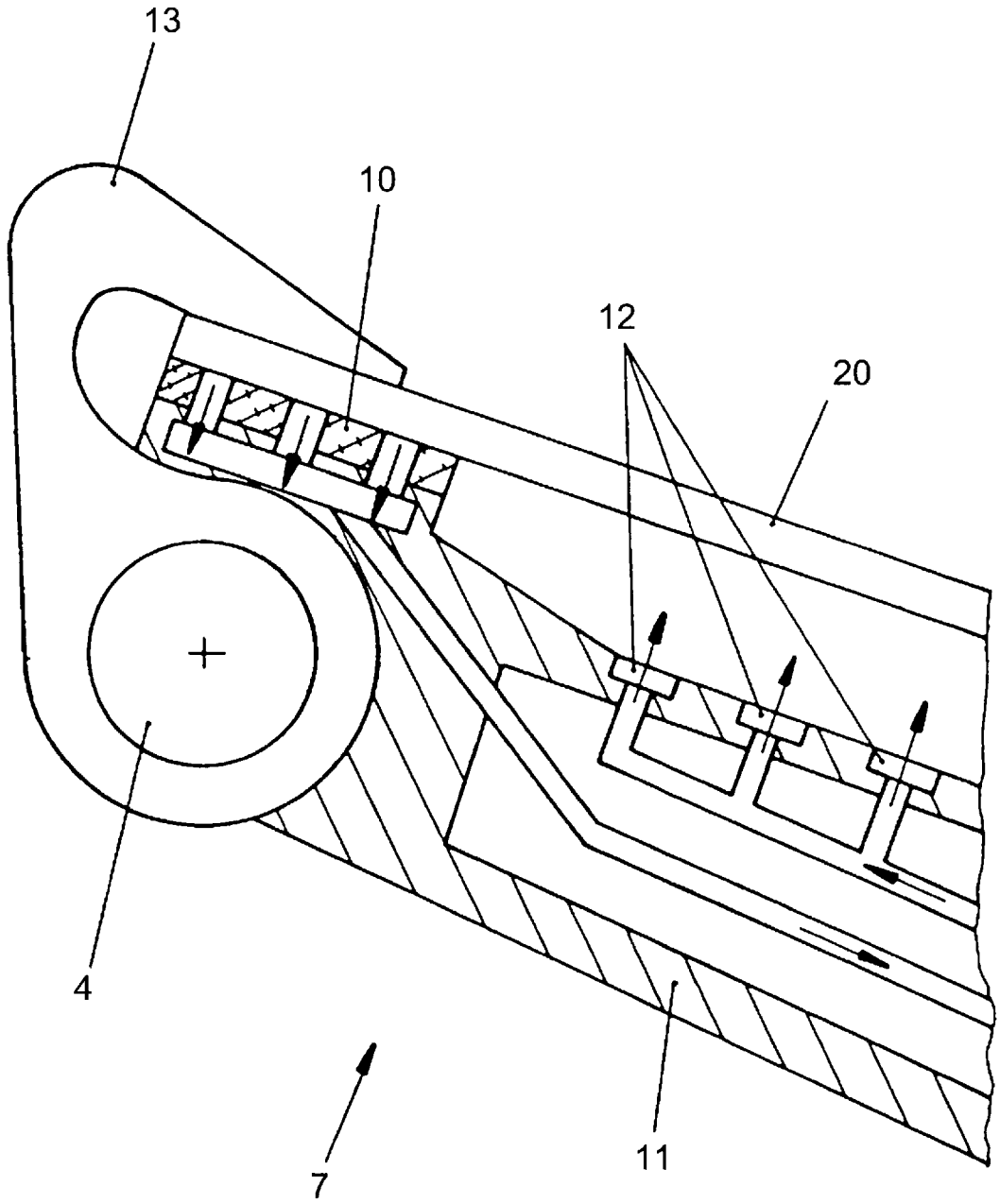
FIG. 3 is a schematic, fragmentary, sectional view of the swing arm of FIG. 2.

For gripping a leading edge of a sheet 20 (FIG. 3), a suction grip 10 is located at the end of the swing arm body 11, as illustrated in FIGS. 2 and 3. The suction grip 10 is in communication with a pneumatic system via an air passageway. The suction grip 10 is operable to hold and release the sheet 20 depending on selective application of vacuum pressure.

The sheet transfer may be further assisted through an air cushion. A preferred embodiment facilitates, wherein the swing arm body 11 includes a plurality of openings 12, as illustrated in FIG. 3. These openings 12 are connected via a passageway to a pneumatic system that produces supplies blowing air, preferably in a selectively controlled manner. In the illustrated embodiment, the air passageway and the openings 12 are integrally formed within the swing arm body 11, but can be otherwise arranged on the swing arm body 11. The suction strips 10 and openings 12 are located at a distal end of the swing arm body 7 so as to be adjacent to the sheet-guiding cylinder 1. Preferably, openings 12 optimize the operation of the suction strip 10, depending upon the length of the printing matter which is to be processed. The pneumatically actuatable openings 12 can be used in order to assist the sheet guidance.

In a further embodiment, also shown in FIG. 3, a gripper system 4 with grippers 13 may be operably mounted at the end of the swing arm body 11 in the region of the suction strip 10. In this embodiment, the suction strip 10 serves as an abutment strip. The suction strip 10 serves for attaching a sheet 20 by suction and the gripper system 4 with grippers 13 serves for additionally fixing the sheet 20 in position during the swinging movement. This additional design can preferably be used for sheet-like printing matter with relatively high weights per unit area, in particular cardboard, paperboard or tin plate. For the period of time over which the respective sheet 20 is attached by suction in the receiving region 5, the suction strip 10 is free; i.e. the grippers 13 have been pivoted away. The grippers 13 are preferably moved via one or more control cams with an appropriate law of motion.

A sheet-directing device (not shown) is preferably assigned to the second sheet-guiding cylinder 2 downstream of the transfer region 6 as seen in the conveying direction 14. This sheet-directing device is arranged outside the circular path 3, at a small distance from the sheet-guiding cylinder 2 and extends approximately to the receiving region of a sheet-guiding cylinder 1 of an adjacently-downstream printing unit. In this case, the sheet-guiding device is preferably designed as a continuous guide surface with openings as air nozzles for applying blowing air and/or suction air.

For a "face-printing" operating mode, the swing arm 7, specifically the swing arm body 11, is fixed in the transfer region 6 (FIG. 2). With the downstream sheet-directing device, the swing arm forms a sheet-guiding system which serves for the sheet guidance on the second sheet-guiding cylinder 2. In this case, the suction strip 10 and the blowing openings 12 on the swing arm body 11 are preferably supplied with blowing air or suction air via a common pneumatic system or separate pneumatic systems, it being possible for said system or systems to be switched over.

For the "face-and-reverse-printing" operating mode, the openings 12 of the swing arm body 11 may be provided with blowing air at least in the conveying direction 14, preferably as the swing arm 7 moves along feed path 18 from the receiving region 5 to the transfer region 6, in order to assist the sheet guidance.

In addition to the above-described arrangement of a swing arm 7 (between two printing units), an embodiment may have multiple swing arms 7 between the series-arranged printing units. The sheet-guiding cylinders 1, 2 may be designed as an impression cylinder and transfer cylinder, respectively, or a storage drum and a transfer drum, respectively, within the printing machine.

Figure 7A:
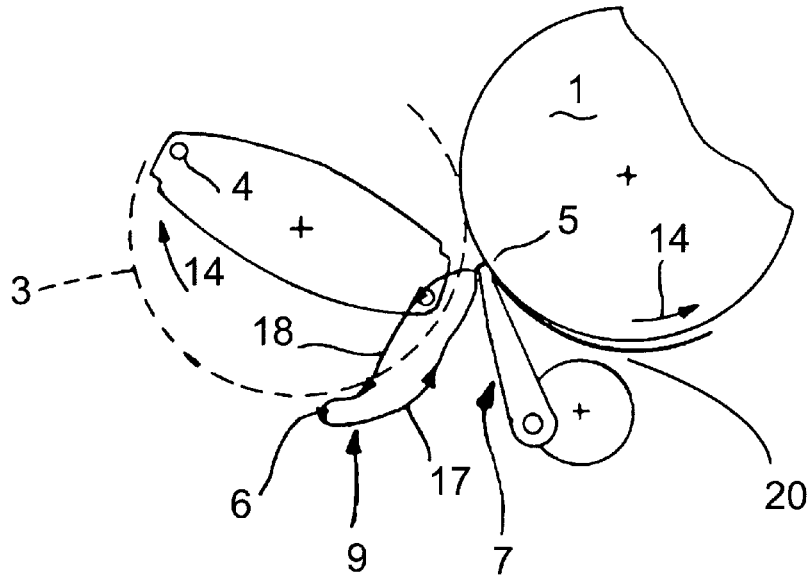
FIGS. 7A–7D are schematic illustrations of the printing machine of FIG. 2, illustrating the swing arm in various sheet-transfer positions: as the swing arm grips a trailing edge of a sheet in a transfer region from the first sheet-guiding cylinder (FIG. 7A); as the swing arm transfers the sheet through the inter-circumferential clearance of the rotary path of the second sheet-guiding cylidner (FIG. 7B); as the swing arm deposits the sheet to a receiving gripper on the second sheet-guiding cylinder (FIG. 7C); and as the swing arm moves on a return path outside of the circumferential rotary path of the second sheet-guiding cylinder (FIG. 7D).

The system of FIGS. 1–3 functions in the following manner, with further reference to FIGS. 7A–7D. Initially, as illustrated in FIG. 7A, a sheet 20 is delivered in the conveying direction 14 on the solid lateral surface of the first sheet-guiding cylinder 1. The sheet is held to the first cylinder 1 with the grippers 13. More particularly, a leading edge (relative to the rotational direction 14 of the cylinder 1) of the sheet 20 is held in position by grippers 13.

For face printing, the sheet 20 is transferred at a tangent point 23 of cylinder 1 relative to the circular path 3 of cylinder 2, whereby the leading edge (relative to the conveying direction 14) is released from the gripper 13 of the first sheet-guiding cylinder 1 and held by the passing gripper 4 of the second sheet-guiding cylinder 2. The appropriate gripper system 4 of the second sheet-guiding cylinder 2 then guides the sheet 20 and transfers the same in the conveying direction 14 to a sheet-guiding cylinder 1 of the next following printing unit. During this operation, the swing arm 7 is fixed in position at a transfer region 6, such that the swing arm body 11 is held in position at a small distance from the second sheet-guiding cylinder 2. In a preferred operation, air is supplied through the blowing openings 12 (FIG. 3) of the fixed swing arm body 11, thereby pneumatically assisting the guidance of the sheet 20 by an air cushion.

For face-and-reverse printing, the swing arm 7 is actuated for movement. As mentioned, the preferred movement of the swing arm 7 is such that the gripper 10 located at a distal end of the swing arm 7 generally follows the path 9, indicated by the dash-dot line. As illustrated in FIG. 2, at machine speed, the first sheet-guiding cylinder 1 carries the leading edge of the printed sheet 20 beyond the tangent point 23. Once a trailing edge of the sheet 20 has passed the tangent point 23, the suction grip 10 of the swing arm 7 grabs the end of the sheet 20 in a receiving region 5, as shown in FIG. 7A. While gripping the sheet 20, the swing arm 7 along a circle arc in the direction of rotation of the first sheet-guiding cylinder 1. Thereafter, the speed of the swing arm 7 is decelerated to zero.

Figure 7B:
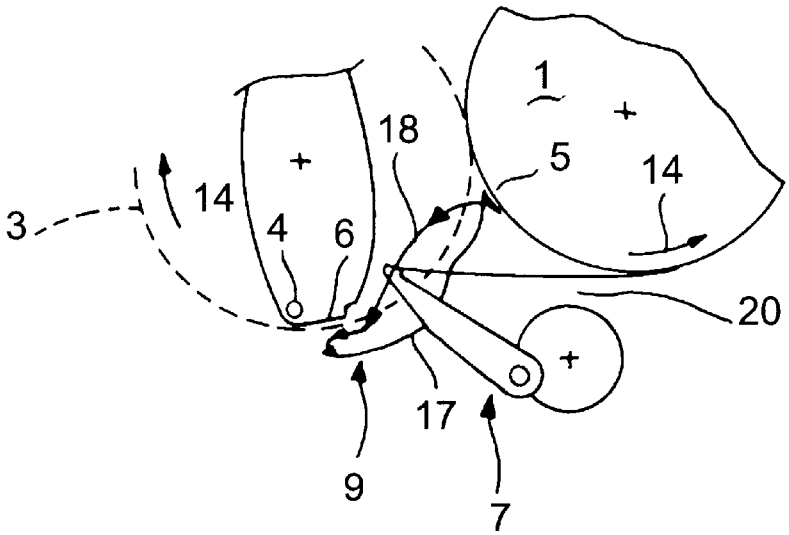

Transferring the sheet 20 from the first cylinder 1, the swing arm 7 then reverses its movement, and the swing arm 7 guides the sheet 20 on the guide path 9 in the direction of the second sheet-guiding cylinder 2. More particularly, the swing arm 7, pulls the sheet 20 away from the first cylinder 1, the gripper 10 of the swing arm 7 being moved along the feed path 18, as shown in FIG. 7B. At this time, the gripped edge of the sheet 20 is now "leading," although the edge was previously "trailing" as carried on the first cylinder 1. Preferably, the feed path 18 intersects the circumference 3 of the second cylinder 2, carrying the gripped edge inside the clearance 16 of the second cylinder 2. By moving along such a feed path 18, the swing arm 7 advantageously draws the sheet off of the upstream first cylinder 1 in an essentially tangentially straightened-out form. This avoids buckling of the sheet 20.

Figure 7C:
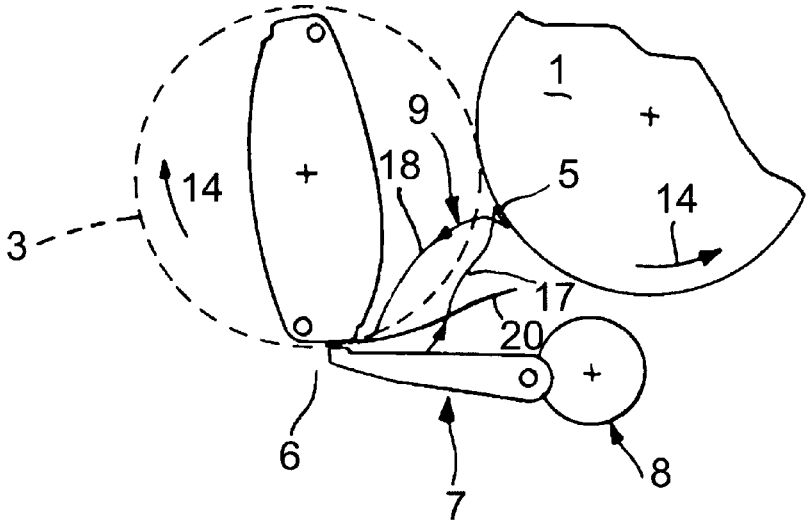

The swing arm 7 passes, with sheet 20, upstream of the gripper 4 of the second sheet-guiding cylinder 2 as seen in the conveying direction 14, the circular path 3 being intersected in the process, into the clearance 16. The swing arm 7, then passes out of the clearance 16, the circular path 3 again being intersected. In the transfer region 6, the swing arm 7 moves to a standby position until the following gripper 4 of the second sheet-guiding cylinder 2 is in the transfer region 6. The sheet 20 is transferred at the transfer region 6, as shown in FIG. 7C. Transferring the sheet 20 to the second cylinder 2, the gripped edge of the sheet 20 is secured to a gripper 4 on the second cylinder 2. Specifically, the grippers 4 of the second sheet-guiding cylinder 2 grip the sheet 20 and released by the suction grip 10 of the swing arm 7, so that the sheet 20 is then transferred in the conveying direction 14 on the cylinder 2. Then the swing arm 7 pivots away from the circular path 3 of the second sheet-guiding cylinder 2, remains there briefly, then moves on the return path 17 back to the receiving region 5, beneath the trailing region of the sheet.

Figure 7D:
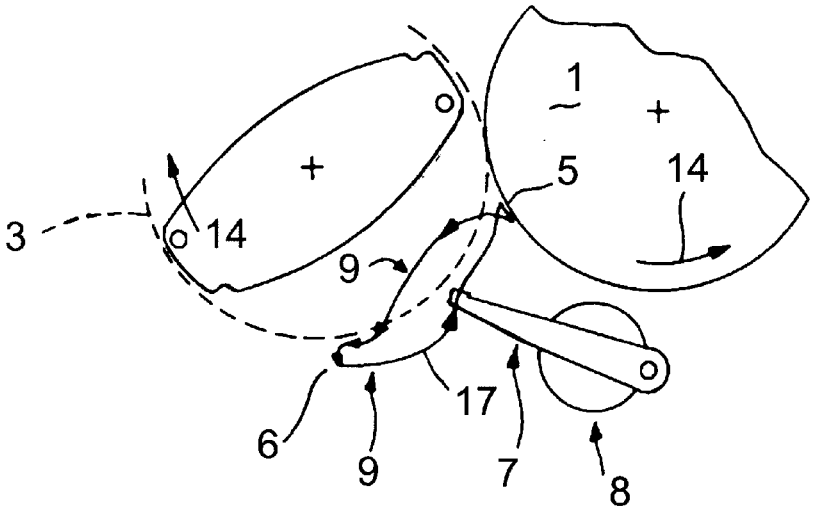

Returning, the swing arm 7 moves away from the second sheet-guiding cylinder 2. The swing arm 7 is accelerated in the direction of the upstream sheet-guiding cylinder 1, moving along the return path 17, as shown in FIG. 7D. The return path 17 may be outside of the circumference 3 of the second cylinder 2. The swing arm 7 returns to standby in the position shown in 7A, ready to receive the next sheet advanced up to the first sheet-guiding cylinder 1. The first sheet-guiding cylinder 1 conveys a next sheet 20 past the swing arm 7, beyond the tangent point 23, the swing arm body 11 is moved in the conveying direction 14, in the same direction as the sheet-guiding cylinder 1, until the trailing edge, or the trailing region, of the sheet 20 is attached on the swing arm 7 by suction, by way of the suction strip 10, and is moved onto the feed path 18.

An advantage is that the swing arm 7 can be moved back to the receiving region 5 on the return path 17, avoiding a trailing region of the sheet 20, thereby avoiding contacting and smearing the sheet as the swing arm returns. Alternatively, however, the swing arm 7 can be moved on the return path 17 which intersects the circular path 3 of the second sheet-guiding cylinder 2, and on the feed path 18 which runs outside the circular path 3. Also, the swing arm 7 can likewise be moved on the feed path 18 and the return path 17 which both intersect the circular path 3 of the second sheet-guiding cylinder 2.

In keeping with the invention, the dimensions of the sheet-guiding cylinders 1, 2 are not restricted to the above-described design wherein these cylinders 1, 2 are double the diameter of a blanket or form cylinder 22 of the printing unit. Rather, the sheet-guiding cylinders with other multiple-sized diameters, e.g. triple-sized or quadruple sized diameters, are also suitable. This also covers a combination of sheet-guiding cylinders 1 and 2 of the same multiple sizing. It is also possible to realize combinations with a double-sized sheet-guiding cylinder 1 or 2 and a triple-sized sheet-guiding cylinder 1 or 2 as well as those with a triple-sized sheet-guiding cylinder 1 or 2 and a quadruple-sized sheet-guiding cylinder 1 or 2.

What is claimed is:

1. A method for turning a sheet in a printing machine, comprising the steps of:

carrying a sheet on a rotating first sheet-guiding cylinder, the sheet having a leading edge and trailing edge relative to a direction of rotation of the first sheet-guiding cylinder;

gripping the trailing edge of the sheet with a movable swing arm, the swing arm having a pivoting swing arm body with a gripper located at an end thereof for gripping a sheet;

transferring the gripped edge of the sheet from the swing arm to a second sheet-guiding cylinder, so that the gripped edge is leading relative to a direction of rotation of the second sheet-guiding cylinder; and moving the swing arm on a guide path which intersects an outer circular path of the second sheet-guiding cylinder.

2. The method according to claim 1, wherein the moving step includes moving the swing arm on a guide-path feed during the transferring step, and wherein the method further comprises: returning the swing arm along a return path which is outside said outer circular path of the second sheet-guiding cylinder after said transferring step and before said gripping step.

3. The method according to claim 1, wherein the transferring step includes moving the swing arm on a feed path which is outside said outer circular path of the second sheet-guiding cylinder, and wherein the moving step includes returning the swing arm along a return path which is outside said outer circular path of the second sheet-guiding cylinder after said transferring step and before said gripping step.

4. The method according to claim 1, wherein the moving step includes the transferring step and also returning the swing arm on a return path after said transferring step and before said gripping step.

5. The method according to claim 1, wherein said gripper is a suction gripper, and wherein the gripping step includes holding the end of a sheet by applying suction, with the swing arm at a machine speed, the method further comprising:

moving the swing arm over a circle arc in the direction of rotation of the first sheet-guiding cylinder;

decelerating the speed of the swing arm until stopped;

reversing and accelerating the swing arm to the machine speed;

passing the sheet to the second sheet-guiding cylinder;

moving the swing arm away from the second sheet-guiding cylinder, and gripping a trailing edge of a next sheet advanced on the first sheet-guiding cylinder with the swing arm.

6. The method according to claim 5, wherein the gripping step includes mechanically gripping both opposite sides of the sheet.

7. An apparatus for turning a sheet in a printing machine, wherein the sheet is carried on a rotatable first sheet-guiding cylinder, the sheet held thereon by at least one first gripper, the sheet having a leading edge and trailing edge relative to a direction of rotation of the first sheet-guiding cylinder; the apparatus comprising:

a second sheet-guiding cylinder including a plurality of second grippers located symmetrically around an outer circumference of the second sheet-guiding cylinder, the second sheet-guiding cylinder having a non-circular cross-section, with a plurality of surfaces forming respective clearance volumes between said surfaces and the outer circumference of the second sheet-guiding cylinder; and a swing arm including a movable swing arm body and a transfer gripper, the transfer gripper operable to receive and grip the trailing edge of the sheet on the first sheet-guiding cylinder, the swing arm being movably mounted to move the between the first sheet-guiding cylinder and the second sheet-guiding cylinder to transfer the gripped edge to be gripped by the gripper on the second sheet-guiding cylinder, the swing arm moving though said clearance.

8. The apparatus according to claim 7, wherein the joint moves eccentrically.

9. The apparatus according to claim 7, wherein the joint includes a cam mechanism.

10. The apparatus according to claim 7, wherein the joint includes an electronic cam plate.

11. The apparatus according to claim 7, wherein the first sheet-guiding cylinder is an impression cylinder and the second sheet-guiding cylinder is a transfer cylinder.

12. The apparatus according to claim 7, wherein the first sheet-guiding cylinder is a storage drum and the second sheet-guiding cylinder is a transfer cylinder.

13. The apparatus according to claim 7, wherein the first and second sheet-guiding cylinders each has a diameter at least double the size of a blanket cylinder.

14. The apparatus according to claim 7, wherein the swing arm has a suction grip, the suction grip being in communication with a pneumatic system to hold a sheet by vacuum pressure.

15. The apparatus according to claim 13, wherein the suction grip is adjustable to accommodate sheets having varying lengths.

16. The apparatus according to claim 13, wherein one or more openings are disposed in the swing arm though which blowing air is supplied to assist in sheet guidance.

17. The apparatus according to claim 13, further comprising a sheet-directing device spaced from the second-sheet guiding cylinder and located downstream of a region where the sheet is transferred from the swing arm to the second sheet-guiding cylinder relative to the conveying direction.

18. The apparatus according to claim 7, wherein the swing arm is fixedly positionable in a region where the sheet is transferred from the swing arm to the second sheet-guiding cylinder relative to the conveying direction in a face-printing operating mode.

19. The apparatus according to claim 18, wherein one or more openings are disposed in the swing arm though which blowing air is supplied to assist in sheet guidance.

20. An apparatus for transferring a sheet delivered on a rotatable first cylinder in a printing machine, the apparatus comprising:

a second cylinder rotatably mounted adjacent the first cylinder, the second cylinder having an outer circumference defined by a rotary path traveled by an radially outermost portion of the second cylinder, the cylinder having a non-circular cross section, forming a plurality of clearances inside of the circumference, the second cylinder further including a plurality of grippers, each gripper being generally located near one of said radially-outward portions; and a swing arm mounted on a joint, the joint being operable to pivot the swing arm and to move the swing arm radially relative to the second cylinder, the swing arm having a gripper operable to grip an edge of a sheet from the first sheet-guiding cylinder, and to transfer the sheet to the second-sheet guiding cylinder, the swing arm being movable on the joint to enter into one of said clearances.

* * * * *